United States Patent [19]

Holloway, Jr.

[11] 4,171,653

[45] Oct. 23, 1979

[54] WRENCH ADAPTER FOR ROTATABLE ENGINE COMPONENT

[76] Inventor: Max L. Holloway, Jr., 2818 E. 28th, Tulsa, Okla. 74114

[21] Appl. No.: 891,229

[22] Filed: Mar. 29, 1978

[51] Int. Cl.[2] ..... B25B 13/48; F02F 7/00

[52] U.S. Cl. ..... 81/180 R; 123/195 A

[58] Field of Search ..... 81/53 R, 71, 90 R, 90 C, 81/121 R, 180 R; 123/195 A

[56] References Cited

U.S. PATENT DOCUMENTS

| | | | |
|---|---|---|---|
| 3,073,206 | 1/1963 | Rudolph | 81/71 X |
| 3,835,736 | 9/1974 | Campbell, Jr. et al. | 81/180 R |
| 4,028,968 | 6/1977 | DeAmicis | 81/71 |

*Primary Examiner*—James G. Smith

*Attorney, Agent, or Firm*—Harvey B. Jacobson

[57] ABSTRACT

An adapter for attachment to a rotatable component of an internal combustion engine to facilitate connection of a wrench to the rotatable component to enable it to be manually rotated or adjusted in either rotational direction. The adapter includes a plate having tubular sleeves rigid therewith receiving fastener devices for securing the plate to a rotatable component with the plate including recess means or projecting means for engagement by various types of wrenches, handles and the like. The adapter is especially useful in conjunction with high performance engines such as those used in racing automobiles, drag racers and the like with the adapter being symmetrical and balanced so that it may be left attached to the rotatable component or it may be removed for use on other engines.

7 Claims, 7 Drawing Figures

Fig. 1
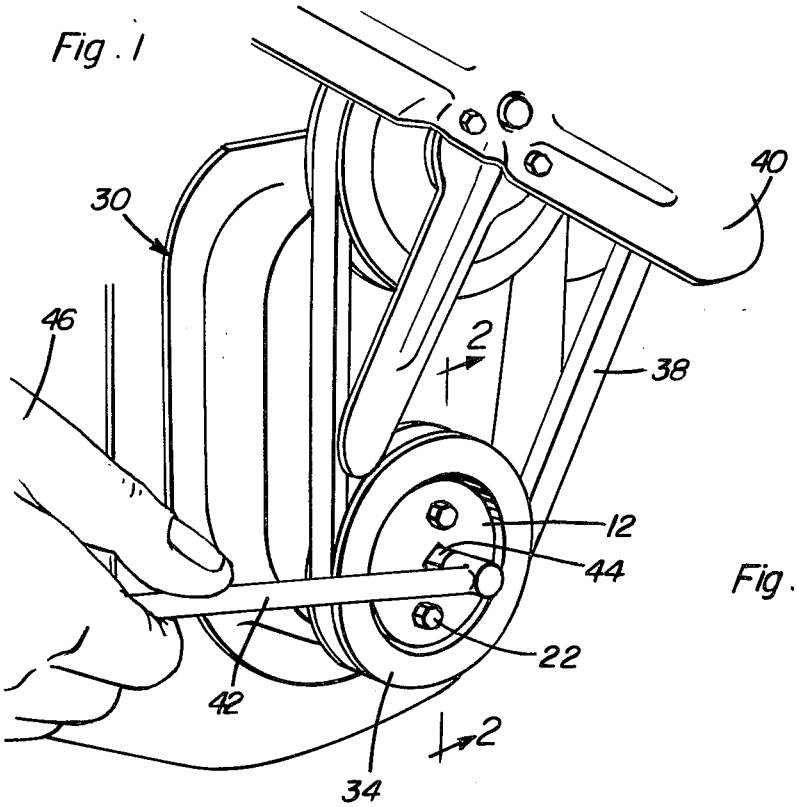
Fig. 3
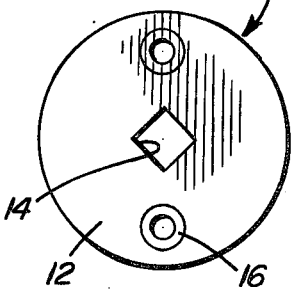
Fig. 4
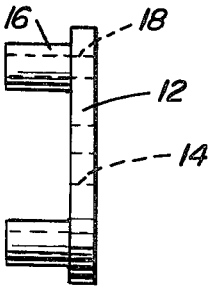
Fig. 2
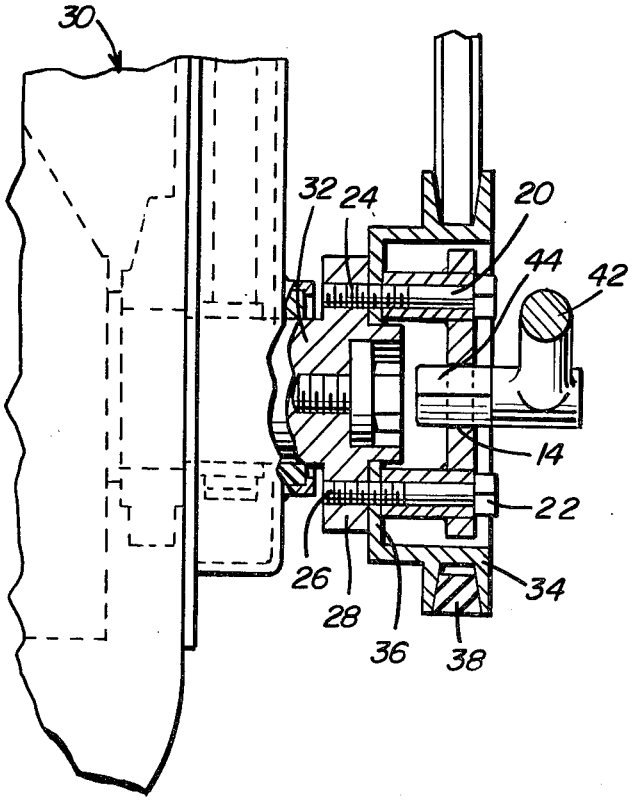
Fig. 5
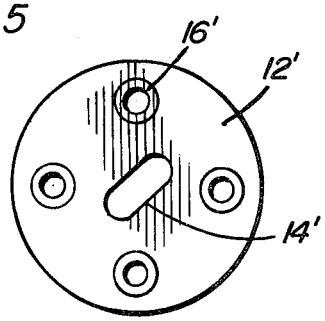
Fig. 6
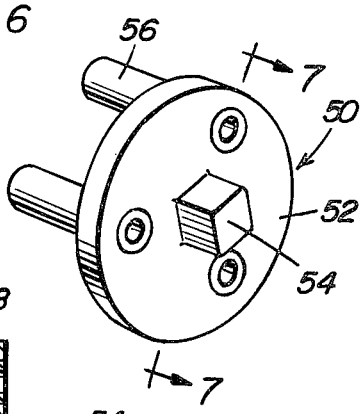
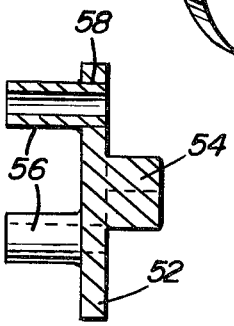
Fig. 7

WRENCH ADAPTER FOR ROTATABLE ENGINE COMPONENT

BACKGROUND OF THE INVENTION

1. Field of the Invention

The present invention generally relates to an attachment for a rotatable component, such as a harmonic balancer, of an internal combustion engine in the form of an adapter to enable a wrench to be connected to the rotatable component of the engine in such a manner that the crank shaft of the engine may be rotated in either direction to a desired angular position with the position of the crank shaft being adjusted accurately to a fraction of a degree.

2. Description of the Prior Art

In various procedures in "tuning" internal combustion engines, it is necessary to rotate the crank shaft to a desired angular position so that opening and closing of the valves and ignition of the combustion mixture may be properly timed in relation to reciprocation of the pistons. Proper timing is especially critical in high performance engines such as those used in drag racers and other high performance vehicles. Various techniques and procedures have been developed by mechanics for rotating the crank shaft of an internal combustion engine including manual cranking devices, wrenches and the like which are usually engaged with a retaining nut for a pulley or other rotatable component which enables the engine to be rotated in one direction but when the retaining nut is turned in an opposite direction, it sometimes becomes loosened. Also, various adapters have been provided to enable a wrench to be connected to a rotatable member with the following U.S. Pat. Nos. being exemplary of the state of this art:

3,073,206—Jan. 15, 1963
3,288,002—Nov. 29, 1966
4,028,968—June 14, 1977

SUMMARY OF THE INVENTION

An object of the present invention is to provide an adapter in the form of a disc or plate symmetrical about a center line and balanced as a complete unit for mounting on or connection with a rotatable component of an internal combustion engine with the disc or plate having means thereon for engagement by a wrench, handle or bar with such means being in the form of a recess, aperture, projection or the like of any desired shape and configuration enabling various types of wrenches, handles and the like to be connected to the disc or plate for rotating it and the rotatable component of the internal combustion engine in either rotational direction.

Another object of the invention is to provide a wrench adapter for rotatable engine components in the form of a disc or plate having tubular sleeves forming means for offsetting the disc or plate from the rotatable component with the disc or plate having apertures aligned with the sleeves for receiving retaining bolts or other fastening means for securing the adapter fixedly to the rotatable component.

Another object of the invention is to provide a wrench adapter in accordance with the preceding objects which can be left attached to the rotatable component of an internal combustion engine during normal operation of the engine or it may be removed for attachment to other engines with the adapter including supporting sleeves arranged in any pattern which facilitates its attachment to specific models of internal combustion engines in which the adapter is quite simple in construction, easy to attach, long lasting and enables accurate adjustment of the engine crank shaft in either direction to a fraction of a degree.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of an internal combustion engine with the adapter of the present invention incorporated thereon and with a wrench connected to the adapter.

FIG. 2 is a vertical sectional view taken substantially upon a plane passing along section line 2—2 of FIG. 1 illustrating further structural details of the typical installation.

FIG. 3 is a rear elevational view of the adapter of the present invention illustrating the positioning of the supporting sleeves thereon.

FIG. 4 is a side elevational view of the structure of FIG. 3.

FIG. 5 is a rear elevational view of another embodiment of the invention illustrating a differently shaped aperture therein and the use of four supporting sleeves.

FIG. 6 is a front perspective view of another embodiment of the invention illustrating a projection on the disc or plate.

FIG. 7 is a transverse, sectional view taken substantially upon section line 7—7 of FIG. 6 illustrating further structural details of this embodiment of the invention.

DETAILED DESCRIPTION OF THE PREFERRED EMBODIMENTS

Referring now specifically to the drawings, the wrench adapter illustrated in FIGS. 1–4 is generally designated by numeral 10 and includes a circular disc or plate 12 having a centrally located square aperture 14 therein and a pair of diametrically opposed tubular sleeves 16 rigidly affixed to the disc 12 with the disc 12 including apertures 18 in alignment with the hollow interior of the sleeves 16 to provide a passageway for attaching bolts or cap screws 20 which extend therethrough with the head 22 of the bolts or cap screws 20 being engaged with the front surface of the circular disc or plate as illustrated in FIGS. 1 and 2. The threaded ends of the bolts or cap screws 20 which are designated by numeral 24 are threaded into internally threaded apertures 26 in a mounting flange 28 on a rotatable component of an internal combustion engine generally designated by the numeral 30. The rotatable component may be the harmonic balancer or other crank shaft component designated by numeral 32 which has the flange 28 integral therewith or rigid therewith. The bolts or cap screws 20 may be replacements for the normal bolts or cap screws used to secure a V-grooved pulley 34 to the rotatable component. For example, the V-grooved pulley 34 may include a plate 36 through which the cap screws or bolts 20 extend with the V-grooved pulley receiving a V-belt 38 such as that which drives a fan 40 or other accessories such as a generator, alternator or the like normally used in an internal combustion engine assembly for an automotive vehicle.

A wrench 42 having a laterally offset polygonal member 44 at one end thereof engages in the aperture 14 as illustrated in FIG. 2 so that the other end of the handle 42 may be grasped by the hand 46 of a mechanic or the like to rotate the circular disc or plate 12 in either direction thereby rotating the rotatable crank shaft or the rotatable component 32 accurately and easily in either rotational direction so that the crank shaft may be accurately adjusted to a fraction of a degree in either direction.

The wrench 42 may be of various shapes and configurations and may include a ratchet wrench or a ratchet head on the handle with the polygonal square member 44 being the drive output of a reversible ratchet head on a wrench. Any other type of wrench may be provided in which the projection 44 corresponds with the shape of the aperture 14 so that it can be inserted into the aperture 14 in the manner illustrated in FIG. 2.

As illustrated in FIG. 5, four sleeves 16' are included on the circular disc 12' and the central aperture 14' is oval shaped in configuration for receiving a wrench or tool having a correspondingly shaped projection.

FIGS. 6 and 7 disclose another embodiment of the adapter generally designated by numeral 50 which includes a circular disc or plate 52 provided with a centrally disposed projection 54 of polygonal configuration on one surface thereof. Three equally spaced sleeves 56 are rigid with the circular plate 52 and actually extend through apertures 58 formed in the circular disc or plate 52 as illustrated in FIG. 7 and are rigidly secured thereto in any suitable manner thus forming a continuous passageway for reception of the mounting bolts or cap screws. This embodiment of the invention enables other types of open-end wrenches, socket wrenches and the like to be connected to the adapter 50 with it being pointed out that the projection 54 may be of various shapes, configurations and sizes to enable various types of wrenches to be employed to rotate the crank shaft in either direction.

The length and orientation of the sleeves may vary and, in some instances, the sleeves may not be used depending upon the shape of the rotatable component to which the disc or plate is attached. The shape, size and configuration of the aperture and projection may also vary but the hole, aperture or projection should be non-circular in configuration to accept a corresponding bar wrench or any other type of wrench. The device is symmetrical about its center and is balanced so that it may be permanently mounted and will not disturb the balance of the rotatable component or it may be removed when no longer in use. The device may be attached by using the conventional attaching bolts or longer attaching bolts may be used where necessary to secure the adapter to the harmonic balancer on the front end of the crank shaft or the device may be attached to any part of the rotatable crank shaft normally accessible to the front of the engine so that the crank shaft can be rotated in either direction by exerting manual pressure on the wrench in order to adjust the crank shaft to a fraction of a degree in either direction.

The foregoing is considered illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with the crank shaft of an internal combustion engine having attachment means at one end thereof, an adapter comprising a disc at one end of the crank shaft, means mounting said disc on the attachment means on the crank shaft, and means on said disc for engagement by a laterally extending handle means to enable rotational torque to be exerted manually on the crank shaft to angularly adjust the crank shaft in either direction with an accuracy to a fraction of a degree.

2. The structure as defined in claim 1 wherein said means for mounting the disc on the crank shaft includes a plurality of apertures in the disc spaced symmetrically about the center thereof for receiving mounting bolts or the like.

3. The structure as defined in claim 2 together with tubular sleeves rigidly affixed to the disc in alignment with the apertures for receiving mounting bolts or the like.

4. The structure as defined in claim 1 wherein said means for engagement by a handle means includes a centrally disposed hole in the disc, said hole being non-circular in configuration for receiving a correspondingly shaped projection on the handle means.

5. The structure as defined in claim 1 wherein said means for engagement by a handle means includes a projection on said disc, said projection being centrally located and being non-circular in configuration for receiving a correspondingly shaped socket means, recess or the like on the handle means to enable manual and accurate adjustment of the angular position of the crank shaft in either direction.

6. In combination with a rotatable component of an internal combustion engine, said rotatable component being operatively connected with the crank shaft of the engine and having attachment means thereon, an adaptor comprising a plate, means mounting said plate on the attachment means on the rotatable component, and means on said plate for engagement by a laterally extending handle means to enable rotational torque to be exerted manually on the rotatable component to angularly adjust the crank shaft in either direction.

7. The structure as defined in claim 6 wherein said rotatable component is a V-grooved pulley mounted on the forward end of the crank shaft, said pulley having an axial recess therein, said plate being in the form of a circular disc received in said recess in the pulley, said handle means being a wrench having a non-circular drive component, said disc having a correspondingly shaped driven component by which rotational torque may be transmitted to the crank shaft.

* * * * *